United States Patent [19]

Carder, Sr. et al.

[11] Patent Number: 5,067,533

[45] Date of Patent: Nov. 26, 1991

[54] CAST NOZZLE HAVING IMPROVED LATCH AND SHUT-OFF MECHANISM

[76] Inventors: Mervin L. Carder, Sr., 78 May Valley La.; E. Leonard Poli, 1375 Greenbirch Ct., both of Fenton, Mo. 63026

[21] Appl. No.: 673,154

[22] Filed: Mar. 18, 1991

Related U.S. Application Data

[63] Continuation of Ser. No. 391,137, Aug. 8, 1989, abandoned.

[51] Int. Cl.[5] ..... B67D 5/371

[52] U.S. Cl. ..... 141/392; 141/209; 141/206

[58] Field of Search ..... 141/392, 206–229; 251/90

[56] References Cited

U.S. PATENT DOCUMENTS

| | | | |
|---|---|---|---|
| 2,686,626 | 8/1954 | Slattery | 141/207 |
| 2,981,299 | 4/1961 | Henry | 141/209 |
| 3,088,500 | 5/1963 | Payne | 141/2.15 X |
| 3,273,609 | 9/1966 | Carder et al. | 141/206 |
| 3,521,680 | 7/1970 | Wood et al. | 141/209 |
| 3,540,496 | 11/1970 | Myers | 141/225 |
| 3,586,072 | 6/1971 | McGahey et al. | 141/225 X |
| 3,586,073 | 6/1971 | Vest et al. | 141/214 |
| 3,653,415 | 4/1972 | Boudot | 141/208 |
| 3,757,834 | 9/1973 | Carder | 141/225 |
| 3,774,656 | 11/1973 | Mayer | 141/206 X |
| 3,817,285 | 6/1974 | Wilder et al. | 137/614.19 |
| 3,877,480 | 4/1975 | Lawrence et al. | 137/329.06 |
| 4,131,140 | 12/1978 | Deters | 141/206 |
| 4,200,128 | 4/1980 | Pokrzywa | 141/392 |
| 4,378,824 | 4/1983 | Carder | 141/206 |
| 4,453,578 | 6/1984 | Wilder | 141/209 |
| 4,487,238 | 12/1984 | Carder, Sr. | 141/206 |
| 4,567,924 | 2/1986 | Brown | 141/207 |
| 4,593,729 | 6/1986 | Tamra | 141/218 |
| 4,596,278 | 6/1986 | Fink, Jr. | 141/207 |

FOREIGN PATENT DOCUMENTS

| | | | |
|---|---|---|---|
| 0607960 | 11/1960 | Canada | 141/225 |

*Primary Examiner*—Henry J. Recla
*Assistant Examiner*—Casey Jacyna

[57] ABSTRACT

A fluid dispensing nozzle for gasoline or the like includes a cast body having an inlet, an outlet, a valve seat between the inlet and the outlet, and a hand guard. Mounted in and on the cast body are a poppet valve for controlling flow through the valve seat, a spring urging the poppet valve closed, a valve stem extending into the poppet valve, a cast lever engaging the valve stem for manually urging the poppet valve away from its seat, and a high-level shut-off means for disabling the lever. The high level shut-off means includes a plunger to which the actuating lever for the nozzle is pivoted, a latch pin, latching balls, and a cylindrical sleeve which acts as a guide for the plunger and as a stop for the latching balls. A hold-open clip is pivoted to the integral hand guard and engages latching teeth on the lever. Release of the high-level shut-off causes a heel portion of the lever to force the clip out of engagement with the teeth.

12 Claims, 4 Drawing Sheets

CAST NOZZLE HAVING IMPROVED LATCH AND SHUT-OFF MECHANISM

This is a continuation application on copending application Ser. No. 07/391,137, filed on Aug. 8, 1991 now abandoned.

BACKGROUND OF THE INVENTION

This invention relates to a dispensing nozzle of the type used for dispensing liquid fuels such as gasoline and the like. It is particularly directed to a compact, relatively inexpensive, and durable dispensing nozzle having a cast body, having improved hold-open means for latching a manually operated lever in an open position, and having improved automatic shut-off means.

Gasoline dispensing nozzles conventionally include a casing having an inlet and an outlet, an outlet spout, and a poppet valve for controlling flow between the inlet and outlet spout. The poppet is urged downwardly against its seat by a spring. A valve stem, which is operated by a manually operated lever or handle, extends into the poppet valve and opens the poppet valve against the force of the spring. The plunger of an automatic shut-off assembly forms a pivot for the lever at the forward end of the lever. The shut-off assembly also includes latching balls which are mounted in an upper portion of the plunger and are pushed outward by a latch pin against a ring carried by a shoulder in the casing. The latch pin includes a tapered surface which engages the balls. The latch pin is carried on one side of a diaphragm, the other side of which defines a pressure chamber with a cap on the body. A spring in the pressure chamber determines the sensitivity of the mechanism to changes in pressure in the pressure chamber. The latch pin is withdrawn from the plunger in response to submerging the end of the outlet spout in liquid. When the latch pin is withdrawn from the plunger, the balls move inward away from the shoulder; the plunger drops, thereby shifting the pivot point and preventing the lever from lifting the valve stem. This construction is well known in the art and is described in my U.S. Pat. No. 3,757,834, No. 4,378,824 and No. 4,487,238, the disclosures of which are hereby incorporated, and in Lawrence et al, U.S. Pat. No. 3,877,480, for example. The construction of the automatic shut-off mechanism requires great precision in the taper angle of the latch pin, the force of the pressure chamber spring, and the face of the ring against which the balls bear. The mechanism is therefore difficult to manufacture accurately and subject to failure with wear.

The automatic shut-off system of commercially available fuel dispensing nozzles drops the pivot point of the manual lever sufficiently to disable the lever from opening the nozzle's valve regardless of the position of the lever. Therefore, the lever may be held by a clip of some sort, to relieve the operator from holding the lever while a fuel tank is being filled. It has been recognized as desirable that the clip be simple, that it hold the lever securely, that it retract automatically when the automatic shut-off operates, so that the lever returns to its rest position, that it not obstruct the lever or the hand of the user in normal operation, and that it be operable with the same hand that is operating the lever. It is also desirable for the clip to be durable and relatively immune to environmental interference such as ice. The clip should also not protrude from the nozzle body or interfere with positioning the nozzle in a fuel tank or on a pump rack.

Various clips have been provided in the past, but none has met all of the foregoing criteria.

SUMMARY OF THE INVENTION

One of the objects of this invention is to provide a simple, durable, easily constructed and maintained, lightweight fuel dispensing nozzle.

Another object of this invention is to provide such a nozzle which has an improved and simplified automatic high-level shut-off system.

Another object of this invention is to provide such a nozzle which has an improved clip and lever arrangement for holding the valve of the nozzle open for unattended operation.

Other objects of this invention will be apparent to those skilled in the art in light of the following description and accompanying drawings.

In accordance with one aspect of the invention, generally stated, a fluid dispensing nozzle is provided including a casing, a main poppet valve, an improved manually operable lever, an automatic high-level shut-off means which forms a pivot for the lever, and an improved clip for holding the lever in a raised position for holding the main valve open. The fluid dispensing nozzle preferably includes a one-piece cast body and hand guard. The shut-off means includes the usual plunger which is slidably mounted in the casing and is connected to the lever. In an upper position of the plunger, the manual lever can lift the main valve of the nozzle to permit flow through the nozzle. In a lower position, the lever is incapable of lifting the valve from its seat. The lever is preferably cast or molded. It is formed in an "S" shape, with a forward arm pivoted to the plunger of the automatic shut-off and also engaging the valve stem of the main poppet valve, an intermediate portion having serrations and a heel part, and a rearward hand-hold. The clip is preferably pivotably mounted to the integral hand guard of the nozzle body, and selectively engages one of the serrations on the lever. When the plunger moves to its lower position, the heel of the lever rocks with respect to the clip and forces the clip out of engagement with the serration. A return spring on the clip pivots it clear of the lever.

In accordance with another aspect of this invention, generally stated, a fluid dispensing nozzle is provided including a cast casing having a main valve, a manually operable lever, and an automatic high-level shut-off means which forms a pivot for the lever. The shut-off means includes the usual plunger which is slidably mounted in the casing and is connected to the lever, a set of balls mounted for radial movement in the upper end of the plunger, a latch pin extending into an axial bore in the plunger and a diaphragm secured to the latch pin for moving the latch pin from a lower position to an upper position. In its lower position, the latch pin extends into the plunger bore and holds the latching balls radially outward against a shoulder to lock the pivot in a first position in which the manual lever can lift the main valve of the nozzle to permit flow through the nozzle. In its upper position, it allows the plunger to be pushed down by the spring of the main valve to a pivot position in which the lever is incapable of lifting the valve from its seat. The shut-off system of the invention is characterized by a cylindrical insert in the cast casing. The lower end of the insert is sealed to the casing and acts as a guide sleeve for the plunger. The upper end of the insert is preferably tapered and acts as a shoulder for engaging the latching balls and holding the plunger in its upper position when the latch pin is in its lower position.

Other aspects of the invention will be better understood in light of the following description of the preferred embodiments of the invention.

DESCRIPTION OF THE PREFERRED EMBODIMENT

Figure 1:
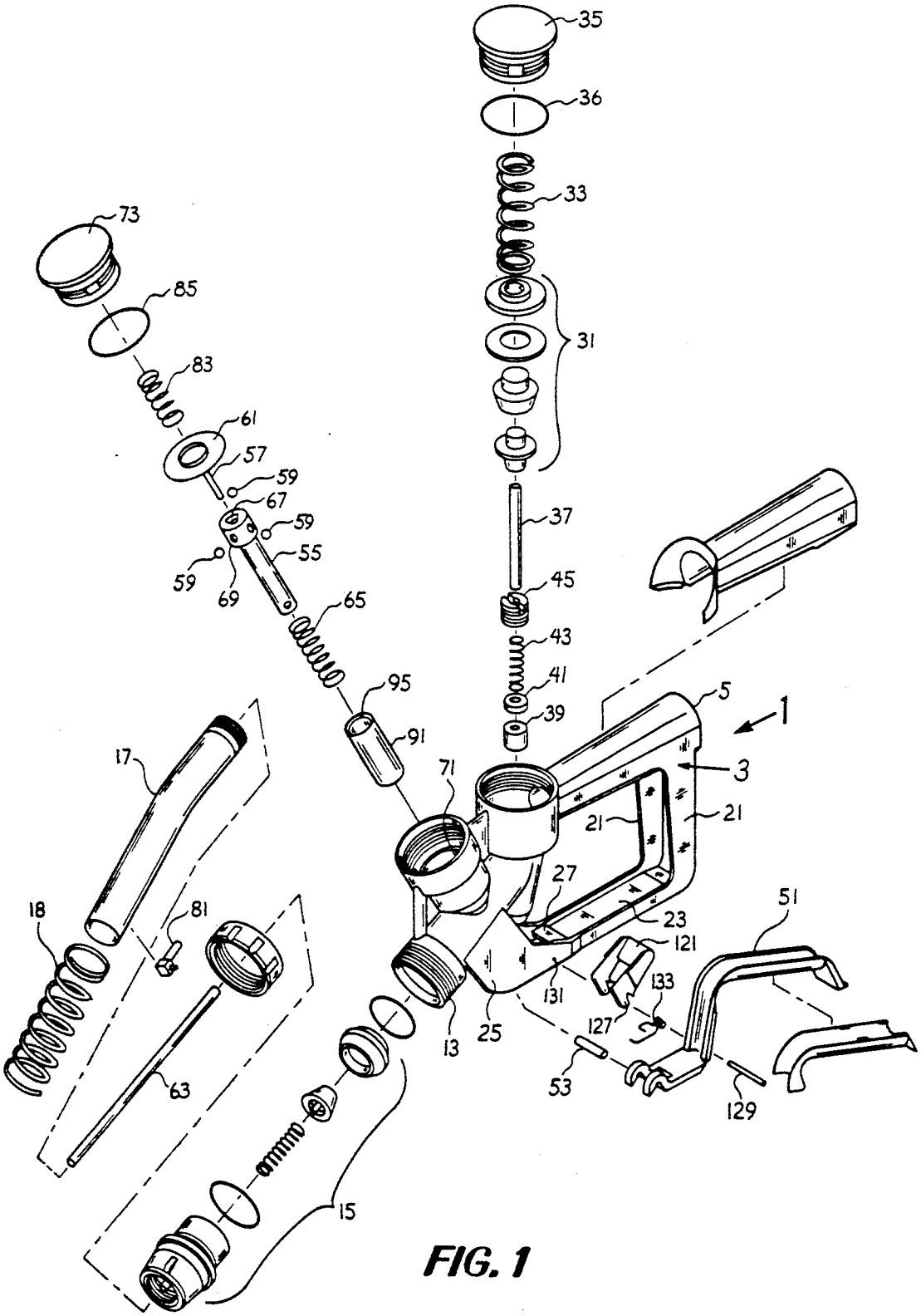
FIG. 1 is an exploded view of a fuel dispensing nozzle of the present invention.

Referring now to the drawings, and in particular to FIGS. 1 and 1*a*, reference numeral 1 indicates one illustrative embodiment of gasoline dispensing nozzle incorporating our invention. The nozzle 1 is similar in construction and operation to the type known in the art as a "type 1A" nozzle. It differs, however, in having a unique cast body 3 having novel fittings, a novel lever and clip system, and a novel construction of its automatic shut-off system.

The cast body 3 is preferably formed of aluminum. It has a passage through it including an inlet 5, a generally cylindrical inlet chamber 7, a valve seat 9, an outlet chamber 11 downstream of the valve seat 9, and an outlet 13. Inlet 5 is threaded to receive a flexible hose from a gasoline pump. The portion of the body forming the inlet chamber 7 forms a hand-hold 8 for the nozzle. Outlet 13 receives a conventional venturi/check valve assembly 15 and a spout 17, including a spring 18, adapted to be inserted into the fill tube of a vehicle fuel tank. The cast body 3 also includes a hand guard 19. The hand guard 19 includes a pair of vertically depending legs 21 at the inlet end of the nozzle, a horizontal lower portion 23, and a pair of upwardly sloping arms 25 at the outlet end of the nozzle. The lower portion 23 is shallowly U-shaped in cross-section. A ledge 27, spaced slightly above the lower portion 23 is provided at the forward, outlet end of the lower portion 23.

Most of the inner parts of the nozzle are standard. A main poppet valve assembly 31 is urged by a poppet spring 33 against the valve seat 9 to close the passage through the casing 3. The poppet spring 33 is held in a novel casing cap 35 threaded into the top of the casing 3. An o-ring 36 forms a seal between the cap 35 and the casing 3. A stem 37 extending from the lower end of the valve 31 is slidably mounted in the casing 3. The lower portion of the stem 37 passes through the casing 3, through a sliding seal consisting of packing 39, held by a packing gland 41, held by a packing spring 43, held by a packing nut 45 threaded into the casing 3. The valve assembly is preferably that disclosed in commonly assigned U.S. Pat. No. 4,487,238, the disclosure of which is incorporated herein.

A novel lever 51 is provided for manually engaging the valve stem 37 and lifting the valve assembly 31 from the valve seat 9. The lever 51 is described hereinafter.

The forward end of the lever 51 is held by a pivot pin 53 to the lower end of a cylindrical plunger 55 which is mounted for reciprocation in the casing 3 as described in more detail hereinafter. The plunger 55 forms a part of an automatic shut-off system for shutting off the flow of gasoline through the nozzle when the level of gasoline in the tank being filled reaches the end of the spout. The shut-off system includes the plunger 55, a latch pin 57, three latching balls 59, a diaphragm 61, the venturi 15, and a breather tube 63. A coil plunger spring 65 biases the plunger 55 upward. The latch pin 57 extends into a blind axial bore 67 in the upper end of the plunger 55. Three radial openings 69 extending from the outer surface of the cylindrical plunger 55 into the axial bore 67 act as guideways for the latching balls 59. The latch pin 57 is preferably of the form shown in commonly assigned U.S. Pat. No. 3,757,834, the disclosure of which is hereby incorporated. The upper end of the latch pin 57 is secured to the center of the diaphragm 61. The periphery of the diaphragm 61 is secured to a shoulder 71 of the the casing 3 by a novel threaded vacuum cap 73 and defines with the vacuum cap 73 a pressure chamber 75 in the casing. The vacuum cap 73 may be identical with the casing cap 35. In addition to the usual threads, the cap 73 includes at least one slot 77 for creating a continuous passage between the pressure chamber 75 and a vacuum passage 79 in the casing. The vacuum passage 79 communicates with the venturi 15, which in turn communicates with a fitting 81 at the downstream end of the spout through the breather tube 63. A balance spring 83 on the upper side of the diaphragm 61 positions the latch pin 57 and determines the sensitivity of the automatic shut-off system. An o-ring 85 forms a seal between the cap 73 and the casing 3.

The portion of the body 3 forming the housing for the shut-off system includes an upstanding cylindrical wall 87 forming a housing for the upper end of the plunger 55. The inner surface of the wall 87 is coaxial with an opening 89 in the lower wall of the body 3. The openings 87 and 89 are slightly tapered to receive a slightly tapered cylindrical steel sleeve 91, which is press-fitted into the openings 87 and 89 from above and extends across the outlet chamber 11 of the body 3. The sleeve 91 includes an enlarged inner wall 93 at its lower end. The wall 93 acts as a guide for plunger 55 and as a bearing for plunger return spring 65. The upper end 95 of the sleeve 91 is beveled inwardly, to form a seat for the balls 59.

The lever 51 is cast of a hard alloy of aluminum. It includes a bifurcated forward claw section 101, a flat valve stem engaging section 103, a clip engaging section 105, a hand grip section 107, and a rest section 109 at the rear of the lever 51.

The claw section 101 includes two downwardly opening U-shaped claws 111 which hook over the pivot pin 53 extending through the lower end of the plunger 31. The claw section 101 is bifurcated sufficiently far back into the lever 51 to permit assembly of the lever onto the pin 53. The plunger 55 is manually pulled down and turned 90°, the lever 51 is inserted between the arms 25 of the hand guard, and the plunger is again turned 90° and released. The arms 25 are sufficiently broad to trap the pin 53 and guard the plunger 55 in all positions of the lever 51.

The section 103 is flat, to permit some sliding movement of the lever with respect to the valve stem 37.

The remaining three sections of the lever 51 are upwardly U-shaped, for strength, lightness, and comfort.

Figure 6:
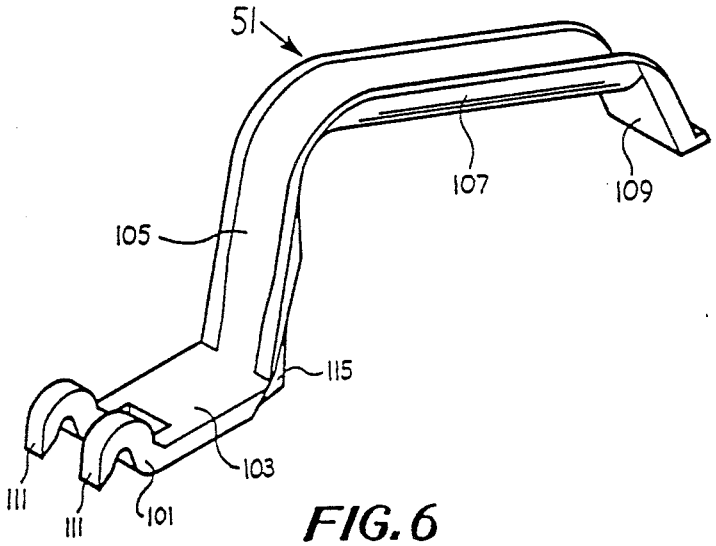
FIG. 6 is a view in perspective of the lever of FIGS. 1–4.
Figure 8:
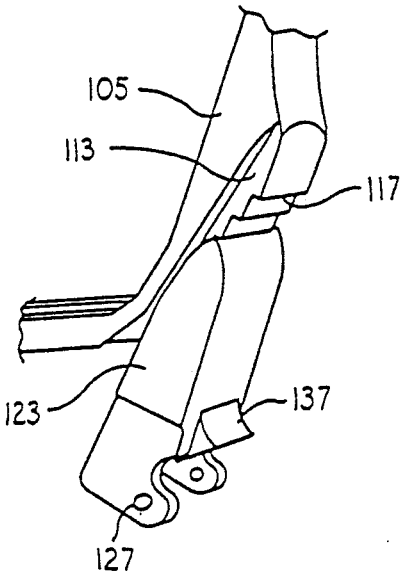
FIG. 8 is a detail in perspective of the lever and clip assembly of FIGS. 1–6.
Figure 9:
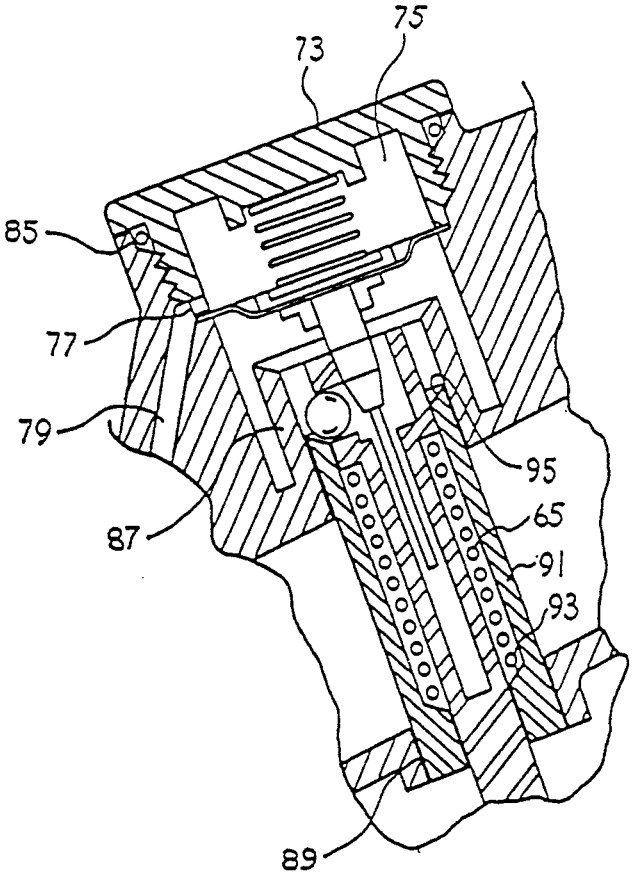
FIG. 9 is a detail of an automatic shut-off portion of the nozzle of FIG. 1, showing a latch pin of the shut-off mechanism being withdrawn from a plunger of the mechanism.

The section 105 forms an angle of about 115° with the section 103. The lower or rear side of the section 105 includes a spine part 113 which is somewhat narrower than the section 105, as shown particularly in FIGS. 6 and 8. The spine part 113 includes a heel part 115 at its lower end, and three step parts 117 above the heel 115.

The hand grip section 107 is smoothly rounded on its lower face, for comfort in gripping the lever.

The rest section 109 extends between the legs 21 of the hand guard in all positions of the lever. When the lever is in its rest position, as in FIG. 2, the lower end of the rest section 109 rests on the horizontal portion 23 of the hand guard and spaces the hand grip section from the hand guard for ease of grasping the lever.

Figure 4:
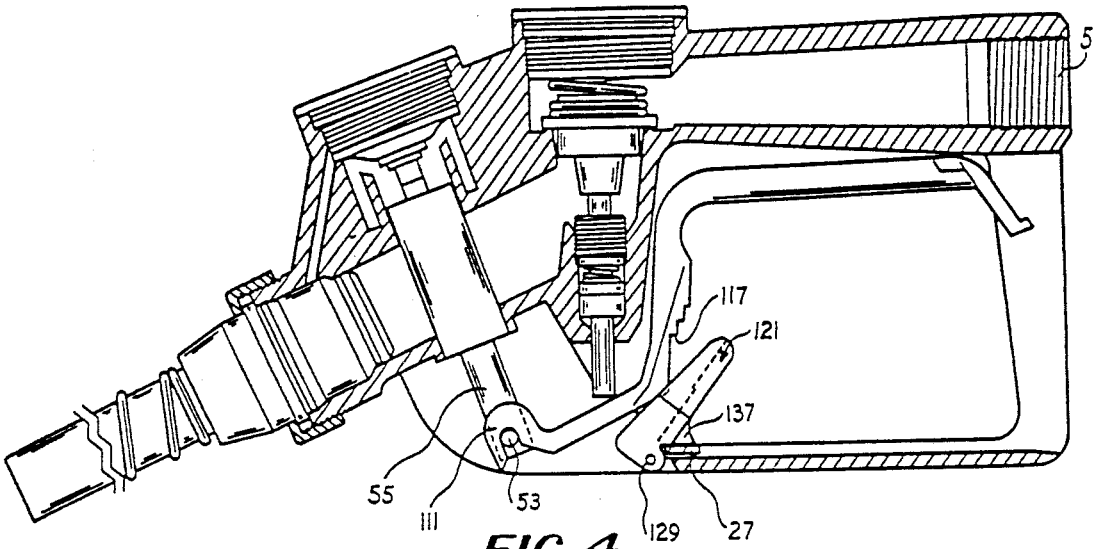
FIG. 4 is a view in axial cross section, corresponding to FIG. 2, showing the lever raised, the clip forced away from the lever, and the poppet valve closed following activation of an automatic shut-off system.
Figure 5:
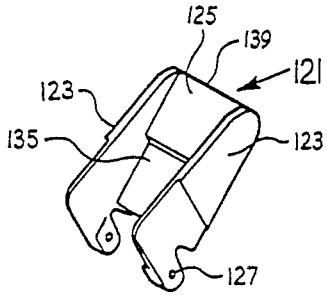
FIG. 5 is a view in perspective of the clip of FIGS. 1–4.

The lever 51 is selectively held in an open position by a clip 121. The clip 121 is cast of hard aluminum alloy. It is generally U-shaped in cross-section and includes a pair of side walls 123 and a rear wall 125. The side walls 123 extend below the rear wall 125 and include holes 127 for a pin 129. The pin 129 extends through corresponding holes 131 at the rear of the arms 25 of the hand guard, for rotatably mounting the clip on the hand guard 19 immediately ahead of the ledge 27. A light coil spring 133 biases the clip 121 rearward, away from the spine part 113 of the lever 51. One end of the coil spring extends under the ledge 27, and the other extends into a pocket 135 in the rear wall 125. A stop part 137 at the lower end of the rear wall 125 prevents excess rearward rotation of the clip 121 by engaging the ledge 27, as shown in FIG. 4.

The clip 121 is the same width as the lever 51, and the spacing between the side walls 123 is slightly greater than the width of the spine 113. The side walls 123 are shaped to be slightly spaced from the rear wall of the clip engaging section 105 of the lever 51 when the clip is pushed forward into engagement with the section 105.

The rear face of the rear wall 125 curves smoothly forward, and its upper end also forms a smooth transition to an upper edge 139.

The operation of the nozzle 1 will be apparent to those skilled in the art. Briefly, when the user grasps the lever 51 with one hand and lifts it from the position shown in FIG. 2 to the position shown in FIG. 3, the latch pin 57 holds balls 59 against the seat 95 at the top of the cylindrical sleeve 91, thereby holding the plunger 55 in its upward position. The lever therefore lifts the valve 31 from the seat 9 to permit gasoline to flow through the nozzle casing 3. In this position, the clip 121 may be rotated forward with the index finger of the same hand. The upper edge 139 of the rear wall 125 engages one of the three steps 117 of the spine part 113 of the lever 51 to lock the lever in any of three positions, corresponding to three different flow rates through the nozzle. The side walls 123 of the clip 121 wrap around the spine 113 to protect the user's hand.

Figure 2:
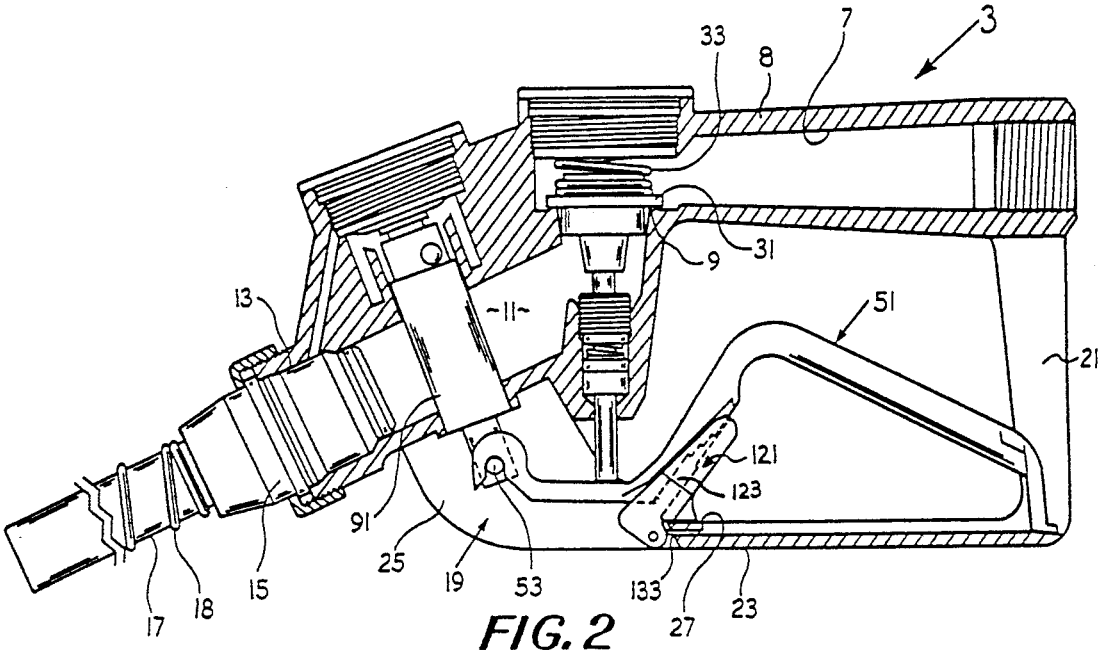
FIG. 2 is a view in axial cross section of the nozzle of FIG. 1, showing the manually operated lever of the nozzle in a rest position and the poppet valve of the nozzle closed.
Figure 3:
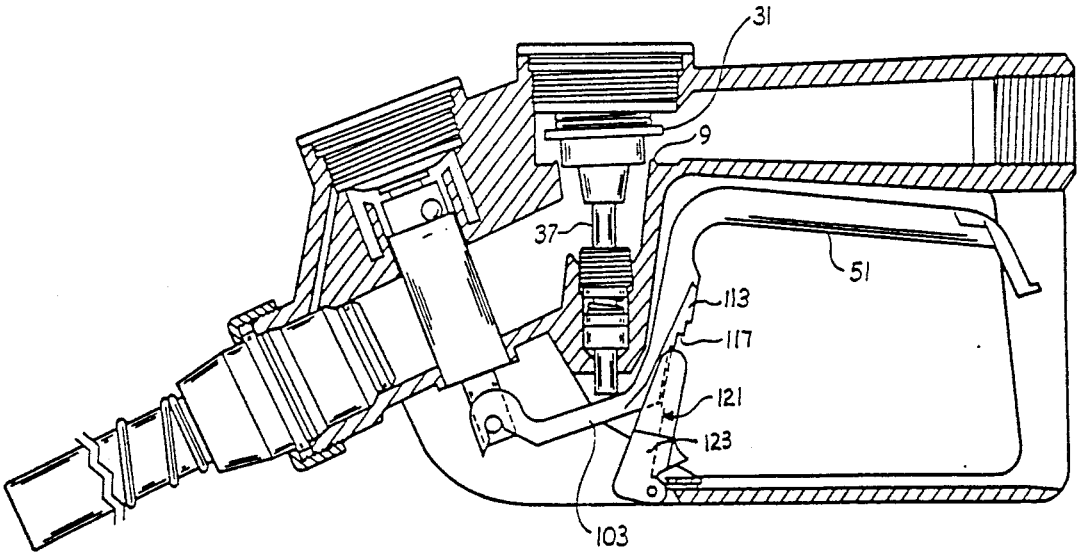
FIG. 3 is a view in axial cross section, corresponding to FIG. 2, showing a clip holding the lever raised and the poppet valve open.
Figure 7:
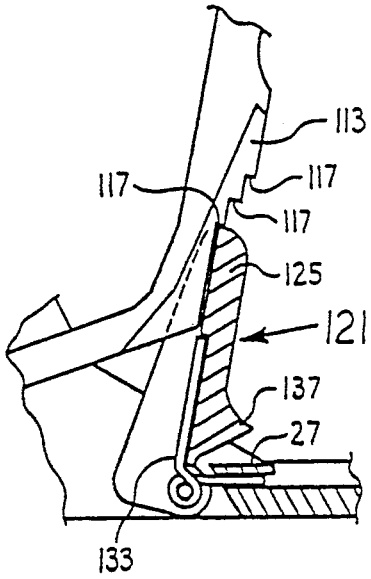
FIG. 7 is a detail, corresponding to FIG. 3, of the clip, lever, and clip spring of FIGS. 1–6, with the clip shown in axial section for clarity.

When the fitting 81 in the nozzle becomes submerged, the decrease in pressure in chamber 75 causes the latch pin 57 to be pulled upward, and the plunger 55 is released. Because the poppet valve spring 33 is far stronger than the plunger spring 65, the valve stem 37 forces the plunger 55 and the lever 51 down. Because the plunger 55 is angled at about a 20° angle from the valve stem 37, and also because the valve stem 39 is forward of the clip 121, the lever 51 rotates forward, and the heel 115 on the lever engages the rear face 125 of the clip and forces the upper edge 139 of the clip 121 out of engagement with the step 117, so that the valve assembly 31 closes. The spring 133 rotates the clip 121 rearward until the stop 137 rests on the ledge 27. As shown in FIG. 2, in this position, as in the open position shown in FIGS. 3, 7 and 8, the side walls 123 of the clip surround the spine portion 113 of the lever 51 and the rear wall 125 is closely adjacent the spine 113. The clip is therefore ready for immediate reuse. In fact, it has been found convenient to push the clip 121 at the same time the lever 51 is lifted, so that the clip is engaged as soon as the desired flow rate is reached.

Numerous variations, within the scope of the appended claims, will be apparent to those skilled in the art in light of the foregoing description and accompanying drawings. Merely by way of example, the parts may be made of different materials. For example, the lever and clip may be made of plastic. The shut-off construction and the clip may each be separately used with other nozzles. It should be noted, however, that the integrally cast hand guard of the preferred embodiment provides a close-tolerance, firm positioning of the clip with respect to both the lever and the other parts of the nozzle body. Although the pivoted clip is preferred, it is also possible to move the clip in other ways, such as making it slidable on the hand guard. These variations are merely illustrative.

We claim:

1. In a liquid dispensing nozzle comprising a casing having an inlet, an outlet spout, a fluid passage therebetween, and a valve seat in the fluid passage; a poppet valve cooperative with the valve seat for closing the fluid passage; biasing means for biasing the poppet valve to a closed position; a valve stem depending from the poppet valve; a manually operable lever cooperative with the valve stem for opening the poppet valve against the bias of the biasing means, the lever being formed in an "S" shape; a hand guard extending below and around the manually operable lever; an automatic shut-off means forming a pivot for the lever, the shut-off means including a plunger moveable to an extended position for disabling the manually operable lever from opening the poppet valve when the outlet spout is immersed in liquid and spring means for returning the plunger to a retracted position; the lever including a forward arm pivoted to the plunger of the automatic shut-off means and also engaging the valve stem of the poppet valve, an intermediate portion, and a rearward hand-hold; and a clip for holding the lever in a raised position for holding the poppet valve open, the improvement wherein the hand guard includes a central horizontal portion and a ledge spaced slightly above the horizontal portion, the lever and the clip are formed in a mold by molding or casting, the clip is rotatably mounted on the hand guard behind and below the intermediate portion of the lever, the clip and lever being rotatable in a common plane, the nozzle further comprising a spine on a lower surface of the intermediate portion of the lever, the spring having a width less than the width of the intermediate portion, a plurality of serrations on the spine, the clip being rotatable into selective engagement with one of the serrations, a return spring for biasing the clip out of engagement with the lever, one end of the return spring extending under the ledge on the hand guard, the clip having a width substantially equal to the width of the intermediate portion, the clip including a rear wall and two side walls surrounding the spine in said engaged position of the clip, the clip further comprising stop means engaging the ledge when the clip is in its rest position for limiting rotation of the clip to a rest position closely adjacent the lever, with the rear wall of the clip substantially parallel to the intermediate portion of the lever and the rear wall and side walls of the clip surrounding the spine when the lever is released and the plunger returned to its retracted position, the rest position of the clip permitting the clip to be easily rotated to said engaged position by one hand of a user holding the lever.

2. The nozzle of claim 1 wherein the spine part includes at least two serrations, the clip being rotatable into selective engagement with either of the serrations.

3. The nozzle of claim 1 wherein the lever and the clip are cast of aluminum.

4. The nozzle of claim 1 including heel means on the lever for automatically disengaging the clip, the heel means being positioned below the serrations and engaging the clip upon activation of the shut-off means to force the clip to rotated toward its rest position.

5. The nozzle of claim 1 wherein the casing and the hand guard are integrally cast as a unit, whereby the position of the clip with respect to the casing is accurately maintained.

6. The nozzle of claim 5 wherein the spine part includes at least two serrations, the clip being rotatable into selective engagement with either of the serrations.

7. The nozzle of claim 5 wherein the lever, the clip, the casing, and the hand guard are all cast of aluminum.

8. The nozzle of claim 5 including heel means on the lever for automatically disengaging the clip, heel means being positioned below the serrations and engaging the clip upon activation of the shut-off means to force the clip to rotate toward its rest position.

9. The nozzle of claim 5 wherein the clip includes a pocket on a forward face of the rear wall, another end of the return spring extending into the pocket.

10. The nozzle of claim 5 wherein the automatic shut-off means plunger includes a transverse pivot pin, and wherein the lever includes a bifurcated forward claw section, the claw section including two downwardly opening U-shaped claws hooked over the pivot pin.

11. The nozzle of claim 1 wherein the clip includes a pocket on a forward face of the rear wall, another end of the return spring extending into the pocket.

12. The nozzle of claim 1 wherein the automatic shut-off means plunger includes a transverse pivot pin, and wherein the lever includes a bifurcated forward claw section, the claw section including two downwardly opening U-shaped claws hooked over the pivot pin.

* * * * *